US008855537B2

(12) United States Patent
Ichizawa

(10) Patent No.: US 8,855,537 B2
(45) Date of Patent: Oct. 7, 2014

(54) TRANSFER ROLLER, IMAGE-FORMING APPARATUS, AND PROCESS CARTRIDGE

(75) Inventor: Nobuyuki Ichizawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 75 days.

(21) Appl. No.: 13/571,579

(22) Filed: Aug. 10, 2012

(65) Prior Publication Data

US 2013/0216280 A1 Aug. 22, 2013

(30) Foreign Application Priority Data

Feb. 21, 2012 (JP) ..... 2012-035512

(51) Int. Cl.
*G03G 15/16* (2006.01)

(52) U.S. Cl.
CPC ..... *G03G 15/16* (2013.01); *G03G 15/1605* (2013.01)
USPC ..... 399/313

(58) Field of Classification Search
CPC ..... G03G 15/1605
USPC ..... 399/313
See application file for complete search history.

(56) References Cited

U.S. PATENT DOCUMENTS

| | | | | | |
|---|---|---|---|---|---|
| 5,359,395 | A * | 10/1994 | Shimura et al. | ..... | 399/176 |
| 6,646,040 | B1 * | 11/2003 | Hara et al. | ..... | 524/495 |
| 6,820,738 | B2 * | 11/2004 | Hara et al. | ..... | 198/844.2 |
| 8,175,496 | B2 * | 5/2012 | Miyamoto | ..... | 399/162 |
| 8,524,315 | B2 * | 9/2013 | Seko et al. | ..... | 427/154 |
| 2003/0119968 | A1 * | 6/2003 | Hara et al. | ..... | 524/495 |
| 2009/0062505 | A1 * | 3/2009 | Miyamoto | ..... | 528/322 |

FOREIGN PATENT DOCUMENTS

| | | | | | |
|---|---|---|---|---|---|
| JP | 2003-202722 | * | 7/2003 | ..... | C08J 7/04 |
| JP | 2003-202722 | A | 7/2003 | | |
| JP | 2011-70202 | A | 4/2011 | | |

* cited by examiner

*Primary Examiner* — Clayton E Laballe
*Assistant Examiner* — Kevin Butler
(74) *Attorney, Agent, or Firm* — Sughrue Mion, PLLC

(57) ABSTRACT

A transfer roller includes a conductive support, a first conductive elastic layer disposed on the conductive support, and a second conductive elastic layer disposed on the first conductive elastic layer. A common logarithm of surface resistivity of the second conductive elastic layer is higher than a common logarithm of volume resistivity of the second conductive elastic layer by about 1 or more.

6 Claims, 5 Drawing Sheets

TRANSFER ROLLER, IMAGE-FORMING APPARATUS, AND PROCESS CARTRIDGE

CROSS-REFERENCE TO RELATED APPLICATIONS

This application is based on and claims priority under 35 USC 119 from Japanese Patent Application No. 2012-035512 filed Feb. 21, 2012.

BACKGROUND (i) Technical Field

The present invention relates to transfer rollers, image-forming apparatuses, and process cartridges.

(ii) Related Art

Electrophotographic image-forming apparatuses charge the surface of an image carrier such as a photoreceptor with a charging device, form an electrostatic latent image with, for example, a laser beam modulated with an image signal, and develop the electrostatic latent image with a charged toner to form a toner image as a visible image. For an intermediate transfer system, the toner image is electrostatically transferred via an intermediate transfer belt to a recording medium such as recording paper and is fixed to the recording medium.

Conductive rollers are developed and used in the art to apply a voltage for transferring the toner image from the image carrier to the surface of the intermediate transfer belt.

SUMMARY

According to an aspect of the invention, there is provided a transfer roller including a conductive support, a first conductive elastic layer disposed on the conductive support, and a second conductive elastic layer disposed on the first conductive elastic layer. A common logarithm of surface resistivity of the second conductive elastic layer is higher than a common logarithm of volume resistivity of the second conductive elastic layer by about 1 or more.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described with reference to the drawings.

Transfer Roller

Figure 1:
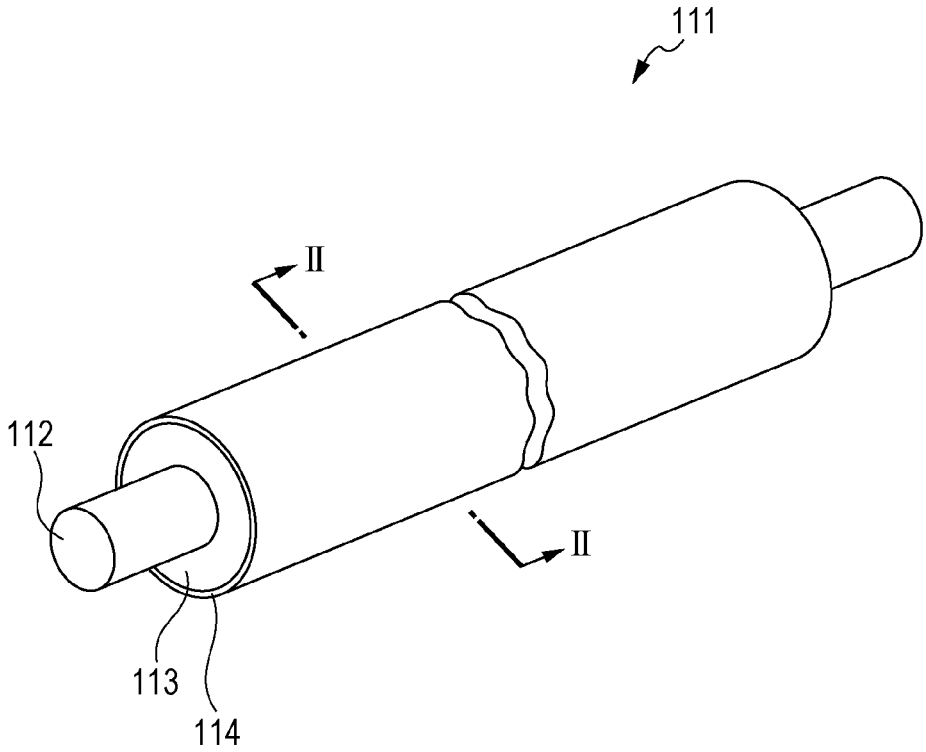
FIG. 1 is a schematic perspective view of a transfer roller according to an exemplary embodiment.
Figure 2:
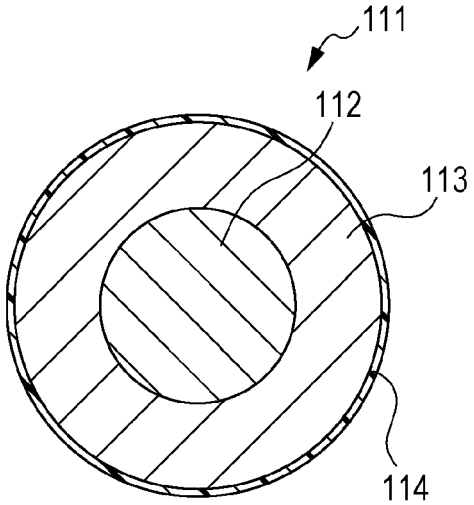
FIG. 2 is a schematic sectional view of the transfer roller according to the exemplary embodiment.

FIG. 1 is a schematic perspective view of a transfer roller according to an exemplary embodiment. FIG. 2 is a schematic sectional view of the transfer roller according to this exemplary embodiment, taken along line II-II of FIG. 1.

As shown in FIGS. 1 and 2, a transfer roller 111 according to this exemplary embodiment includes, for example, a hollow or solid cylindrical conductive support (shaft) 112, a first conductive elastic layer 113 disposed on the outer surface of the conductive support 112, and a second conductive elastic layer 114 disposed on the outer surface of the first conductive elastic layer 113.

The common logarithm of the surface resistivity of the second conductive elastic layer 114 is higher than the common logarithm of the volume resistivity of the second conductive elastic layer 114 by 1 or more or about 1 or more. It should be noted that the common logarithm (log Ω/sq) of the surface resistivity of the second conductive elastic layer 114 and the common logarithm (log Ω·cm) of the volume resistivity of the second conductive elastic layer 114 are compared for their values by ignoring their units.

The transfer roller 111, thus constructed, according to this exemplary embodiment may scatter little toner during transfer.

While the mechanism is not fully understood, it is believed to be as follows.

A transfer roller for use with an image-forming apparatus is disposed opposite an image carrier or a support roller (hereinafter "other roller"). In use, the other roller applies a load to the transfer roller to form a nip (i.e., a region where the transfer roller is pressed by the other roller). As a voltage is applied across the nip, a current flows across the nip from the transfer roller to the other roller or from the other roller to the transfer roller. The transfer roller, however, might cause discharge or leak current in the region around the nip (i.e., a region where the transfer roller is not pressed by the other roller).

If the transfer roller is applied to an image-forming apparatus, the discharge or leak current might scatter toner during transfer, thus causing degradation (blurring) in the resulting image.

For the transfer roller 111 according to this exemplary embodiment, the common logarithm of the surface resistivity of the second conductive elastic layer 114 is higher than the common logarithm of the volume resistivity of the second conductive elastic layer 114 by 1 or more or about 1 or more. That is, the second conductive elastic layer 114 is anisotropic in conductivity between the planar and radial directions. The second conductive elastic layer 114 may therefore allow less current to flow in the planar direction than in the radial direction.

If the transfer roller 111 forms a nip with another roller in an image-forming apparatus, the transfer roller 111 may allow a current to flow across the nip from the transfer roller to the other roller or from the other roller to the transfer roller without causing substantial discharge or leak current in the region around the nip.

If the transfer roller 111 is applied to an image-forming apparatus, therefore, the transfer roller 111 may scatter little toner during transfer, thus causing little degradation (blurring) in the resulting image.

As used herein, the term "planar direction" refers to a direction parallel to a plane.

The illustrated structure is not intended to be limiting. For example, the transfer roller 111 according to this exemplary embodiment may include an intermediate layer between the first conductive elastic layer 113 and the conductive support 112. The transfer roller 111 may also include a resistanceadjusting layer or transfer-preventing layer between the first conductive elastic layer 113 and the second conductive elastic layer 114.

The components of the transfer roller 111 according to this exemplary embodiment will now be described in detail.

Conductive Support

The conductive support 112 functions both as an electrode and as a support for the transfer roller 111.

The conductive support 112 is made of, for example, a metal such as iron (e.g., free-cutting steel), copper, brass, stainless steel, aluminum, or nickel.

The conductive support 112 may also be, for example, a member (e.g., a resin or ceramic member) having the outer surface thereof plated or a member (e.g., a resin or ceramic member) having a conductor dispersed therein.

The conductive support 112 may be either a hollow member (tubular member) or a solid member.

First Conductive Elastic Layer

The first conductive elastic layer 113 contains, for example, a rubber (elastomer) and optionally a conductor and other additives. The first conductive elastic layer 113 may be either a foamed conductive elastic layer or an unfoamed conductive elastic layer.

The rubber (elastomer) is, for example, an elastomer having at least a double bond in the chemical structure thereof.

Examples of rubbers include isoprene rubber, chloroprene rubber, epichlorohydrin rubber, butyl rubber, polyurethane, silicone rubber, fluoroelastomer, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene-propylene-diene monomer terpolymer rubber (EPDM), acrylonitrile-butadiene copolymer rubber (NBR), natural rubber, and mixtures thereof.

Particularly preferred are polyurethane, EPDM, epichlorohydrin-ethylene oxide copolymer rubber, epichlorohydrin-ethylene oxide-allyl glycidyl ether copolymer rubber, NBR, and mixtures thereof.

The conductor is optionally used, particularly if the rubber has low or no conductivity. The conductor is, for example, an electron conductor or an ionic conductor.

Examples of electron conductors include carbon blacks such as Ketjenblack and acetylene black; pyrolytic carbon; graphite; powdered conductive metals and alloys such as aluminum, copper, nickel, and stainless steel; powdered conductive metal oxides such as tin oxide, indium oxide, titanium oxide, tin oxide-antimony oxide solid solution, and tin oxide-indium oxide solid solution; and powdered insulating materials having the surfaces thereof treated to impart conductivity.

Examples of carbon blacks include Special Black 350, Special Black 100, Special Black 250, Special Black 5, Special Black 4, Special Black 4A, Special Black 550, Special Black 6, Color Black FW200, Color Black FW2, and Color Black FW2V available from Degussa AG and MONARCH 1000, MONARCH 1300, MONARCH 1400, MOGUL-L, and REGAL 400R available from Cabot Corporation.

Such electron conductors may be used alone or in combination.

The content of the electron conductor may be, for example, 1 to 30 parts by mass, preferably 15 to 25 parts by mass, per 100 parts by mass of the rubber.

Examples of ionic conductors include quaternary ammonium salts (e.g., perchlorates, chlorates, hydrofluoroborates, sulfates, ethosulfates, and benzyl halides (e.g., benzyl bromides and benzyl chlorides) of lauryl trimethyl ammonium, stearyl trimethyl ammonium, octadodecyl trimethyl ammonium, dodecyl trimethyl ammonium, hexadecyl trimethyl ammonium, and modified fatty acid dimethyl ethyl ammonium)), salts of aliphatic sulfonic acids, salts of sulfuric acid esters of fatty alcohols, ethylene oxide adducts of salts of sulfuric acid esters of fatty alcohols, salts of phosphoric acid esters of fatty alcohols, ethylene oxide adducts of salts of phosphoric acid esters of fatty alcohols, betaines, ethylene oxide adducts of fatty alcohols, fatty acid esters of polyethylene glycol, and fatty acid esters of polyalcohols.

Such ionic conductors may be used alone or in combination.

The content of the ionic conductor may be, for example, 0.1 to 5.0 parts by mass, preferably 0.5 to 3.0 parts by mass, per 100 parts by mass of the rubber.

Examples of other additives include materials that are commonly added to elastic layers, such as foaming agents, foaming aids, softeners, plasticizers, curing agents, vulcanizers, vulcanization accelerators, antioxidants, surfactants, coupling agents, and fillers (e.g., silica and calcium carbonate).

The common logarithm of the volume resistivity of the first conductive elastic layer 113 is preferably 6 to 8 (log Ω·cm), more preferably 6.5 to 7.5 (log Ω·cm), to ensure high image quality. The volume resistivity (Ω·cm) of the first conductive elastic layer 113 is determined by the following procedure.

The volume resistivity of the first conductive elastic layer 113 is adjusted depending on, for example, the type and amount of conductor added.

Procedure for Measuring Volume Resistivity of First Conductive Elastic Layer

The procedure for measuring the volume resistivity of the first conductive elastic layer 113 will now be described with reference to FIG. 3.

A measurement roller 60 is first provided by removing the second conductive elastic layer 114 from the transfer roller 111 to expose the first conductive elastic layer 113.

Figure 3:
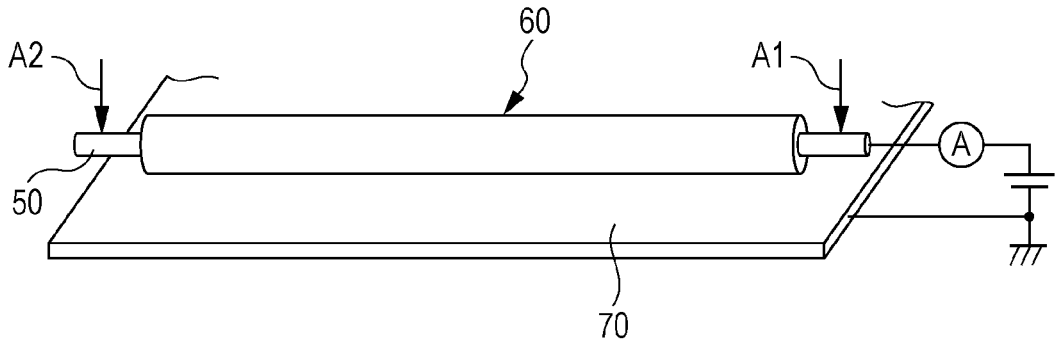
FIG. 3 is a schematic view illustrating a procedure for measuring the volume resistivity of a first conductive elastic layer according to the exemplary embodiment.

As illustrated in FIG. 3, the measurement roller 60 is placed on a metal plate 70. A voltage of 1,000 V is applied across a core 50 and the metal plate 70 at 22° C. and 55% RH while applying a load of 500 g to the positions indicated by the arrows A1 and A2 at both ends of the core 50. The current I (A) is read after 10 seconds, and the volume resistance (R) is calculated by the equation R=V/I. This measurement and calculation is carried out at four positions by rotating the measurement roller 60 by 90° in the circumferential direction, and the average volume resistance (R) is calculated as the volume resistance (R) of the measurement roller 60.

The volume resistivity (ρv) (Ω·cm) of the first conductive elastic layer 113 is calculated from the volume resistance (R) of the measurement roller 60 by the following equation:

$$\rho v = L \times W \times R / t$$

where L (cm) is the length of the roller 60 in the axial direction, W (cm) is the width of the contact (nip) between the roller 60 and the electrode, and t (cm) is the thickness of the first conductive elastic layer 113. The above equation yields the resistivity.

The thickness of the first conductive elastic layer 113 may be, for example, 5 to 20 mm, preferably 5 to 15 mm.

Second Conductive Elastic Layer

The common logarithm of the surface resistivity of the second conductive elastic layer 114 is higher than the common logarithm of the volume resistivity of the second conductive elastic layer 114 by 1 or more or about 1 or more.

The surface resistivity (log Ω/sq) and volume resistivity (log Ω·cm) of the second conductive elastic layer 114 are measured by the following procedures.

Procedure for Measuring Surface Resistivity of Second Conductive Elastic Layer

The second conductive elastic layer 114 of the transfer roller 111 is first cut open into a sheet. The sheet is cut in the center thereof to form a 4×4 cm measurement sample.

The surface resistivity is measured using a circular probe (e.g., UR Probe for HIRESTA IP available from Mitsubishi Petrochemical Co., Ltd.) in accordance with JIS K 6911 (Japanese Industrial Standards). The procedure for measuring the surface resistivity will now be described with reference to FIGS. 4A and 4B.

Figure 4A:
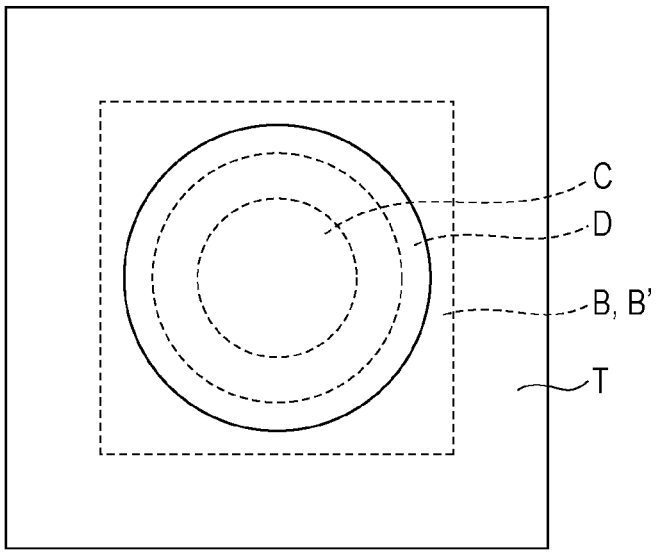
FIGS. 4A and 4B are a schematic plan view and a schematic sectional view, respectively, of an example of a circular probe for measuring the surface resistivity and volume resistivity of a second conductive elastic layer according to the exemplary embodiment.
Figure 4B:
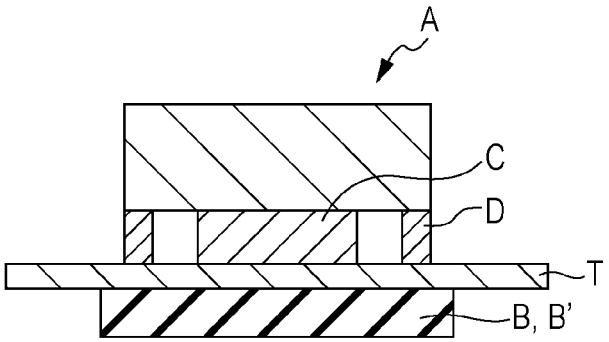

FIGS. 4A and 4B are a schematic plan view and a schematic sectional view, respectively, of an example of a circular probe. The circular probe illustrated in FIGS. 4A and 4B includes a first voltage-applying electrode A and an insulating plate B. The first voltage-applying electrode A includes a cylindrical electrode portion C and a ring electrode portion D having an inner diameter larger than the outer diameter of the cylindrical electrode portion C and surrounding the cylindrical electrode portion C at a predetermined spacing.

The surface resistivity of the second conductive elastic layer 114 is determined as follows. The measurement sample (indicated at T in FIGS. 4A and 4B) is held between the electrode portions C and D of the first voltage-applying electrode A and the insulating plate B, with the outermost surface of the second conductive elastic layer 114 facing upward. A voltage V (V) is then applied across the electrode portions C and D of the first voltage-applying electrode A to measure the current I (A) that flows thereacross. The surface resistivity ρs (Ω/sq) is calculated by the following equation:

$$\rho s=\pi\times(D+d)/(D-d)\times(V/I)$$

where d (mm) is the outer diameter of the cylindrical electrode portion C, and D (mm) is the inner diameter of the ring electrode portion D.

In this exemplary embodiment, the surface resistivity of the second conductive elastic layer 114 is calculated from the current measured using a circular probe (UR Probe for HIRESTA IP available from Mitsubishi Petrochemical Co., Ltd., outer diameter of cylindrical electrode portion C: 16 mm, inner diameter of ring electrode portion D: 30 mm, outer diameter of ring electrode portion D: 40 mm) at 22° C. and 55% RH after a voltage of 500 V is applied for ten seconds.

Procedure for Measuring Volume Resistivity of Second Conductive Elastic Layer

The volume resistivity is measured using a circular probe (e.g., UR Probe for HIRESTA IP available from Mitsubishi Petrochemical Co., Ltd.) in accordance with JIS K 6911. The procedure for measuring the volume resistivity of the second conductive elastic layer 114 will now be described with reference to FIGS. 4A and 4B.

The system and sample used for volume resistivity measurement are the same as for surface resistivity measurement except that the insulating plate B, used for surface resistivity measurement, of the circular probe illustrated in FIGS. 4A and 4B is replaced by a second voltage-applying electrode B'.

The measurement sample (indicated at T in FIGS. 4A and 4B) is held between the electrode portions C and D of the first voltage-applying electrode A and the second voltage-applying electrode B'. A voltage V (V) is then applied across the cylindrical electrode portion C of the first voltage-applying electrode A and the second voltage-applying electrode B' to measure the current I (A) that flows thereacross. The volume resistivity ρs (Ω·cm) of the measurement sample is calculated by the following equation:

$$\rho v=2.011\times(V/I)/t$$

where t (cm) is the thickness of the measurement sample.

In this exemplary embodiment, the volume resistivity of the second conductive elastic layer 114 is calculated from the current measured using a circular probe (UR Probe for HIRESTA IP available from Mitsubishi Petrochemical Co., Ltd., outer diameter of cylindrical electrode portion C: 16 mm, inner diameter of ring electrode portion D: 30 mm, outer diameter of ring electrode portion D: 40 mm) at 22° C. and 55% RH after a voltage of 500 V is applied for ten seconds.

The coefficient 2.011 in the above equation is the electrode coefficient for conversion to resistivity and is calculated by $\pi(d/10)^2/4$ from the outer diameter d (mm) of a cylindrical electrode portion. The thickness of the measurement sample is measured using a CTR-1500E eddy-current type thickness meter available from Sanko Electronic Laboratory Co., Ltd.

The second conductive elastic layer 114 contains, for example, a rubber (elastomer) and optionally a conductor and other additives. The second conductive elastic layer 114 may be either a foamed conductive elastic layer or an unfoamed conductive elastic layer. If the second conductive elastic layer 114 is provided by stretching a tubular elastic member in the radial direction, as described later, an unfoamed conductive elastic layer may be used to ensure sufficient strength.

The second conductive elastic layer 114 is, for example, tensioned to come into close contact with the first conductive elastic layer 113. For example, the tubular elastic member that forms the second conductive elastic layer 114 is stretched in the radial direction, but not in the longitudinal direction, to come into close contact with the outer surface of the first conductive elastic layer 113.

The second conductive elastic layer 114 formed by the tubular elastic member stretched in the radial direction may be anisotropic in conductivity, i.e., may allow less current to flow in the planar direction than in the radial direction.

The second conductive elastic layer 114 may be more anisotropic as the elongation of the tubular elastic member in the radial direction is higher. This may contribute to less discharge or leak current in the region around a nip formed by the transfer roller 111. A moderate elongation is desirable, however, to ensure sufficient strength.

The elongation of the tubular elastic member in the radial direction is preferably 50% to 100% or about 50% to about 100%, more preferably 55% to 95% or about 55% to about 95%, and most preferably 70% to 90% or about 70% to about 90%. This may ensure that the common logarithm of the surface resistivity of the second conductive elastic layer 114 is higher than the common logarithm of the volume resistivity by 1 or more or about 1 or more and that the second conductive elastic layer 114 has sufficient strength.

The elongation of the tubular elastic member in the radial direction is calculated by the following equation:

$$\text{Elongation}(\%)=100\times(\text{inner diameter }\phi\text{ after stretching}-\text{inner diameter }\phi\text{ before stretching})/\text{inner diameter }\phi\text{ before stretching}$$

There is no upper limit on the difference between the common logarithms of the surface resistivity and volume resistivity of the second conductive elastic layer 114 (common logarithm of surface resistivity−common logarithm of volume resistivity).

If, for example, the second conductive elastic layer 114 is provided by stretching the tubular elastic member that forms the layer in the radial direction, the difference between the common logarithms of the surface resistivity and volume resistivity of the second conductive elastic layer 114 may be 3 or more to ensure sufficient strength.

The common logarithm of the volume resistivity of the second conductive elastic layer 114 is preferably 6 to 8 (log Ω·cm), more preferably 6.5 to 7.5 (log Ω·cm), which matches the preferred range of volume resistivity of the first conductive elastic layer 113. This may allow smooth charge transfer between the first conductive elastic layer 113 and the second conductive elastic layer 114, thus accumulating little charge therebetween. As a result, the transfer roller 111 may maintain its volume resistivity. If the transfer roller 111 is applied to an image-forming apparatus, it may cause few image defects due to increased volume resistivity.

The volume resistivity of the second conductive elastic layer 114 is adjusted depending on, for example, the type and amount of conductor added.

The common logarithm of the surface resistivity of the second conductive elastic layer 114, which is higher than the common logarithm of the volume resistivity by 1 or more or about 1 or more, is preferably 7 or more (log Ω/sq). There is no upper limit on the surface resistivity of the second conductive elastic layer 114, although it is preferably 10 or less (log Ω/sq), more preferably 9 or less (log Ω/sq).

The surface resistivity of the second conductive elastic layer 114 is adjusted depending on, for example, the type and amount of conductor added and the elongation of the tubular elastic member that forms the layer 114 in the radial direction.

The thickness of the second conductive elastic layer 114 may be, for example, 0.1 to 1 mm, preferably 0.3 to 0.8 mm.

The constituents of the second conductive elastic layer 114 will now be described.

The rubber (elastomer) is, for example, an elastomer having at least a double bond in the chemical structure thereof. Examples of rubbers include those described for the first conductive elastic layer 113.

The conductor is optionally used, particularly if the rubber has low or no conductivity. The conductor is, for example, an electron conductor or an ionic conductor. Examples of electron conductors and ionic conductors include those described for the first conductive elastic layer 113.

The second conductive elastic layer 114 may be ionically conductive, which allows the volume resistivity thereof to be easily controlled to the range of 6 to 8 (log Ω·cm).

For example, the rubber may be a mixture of epichlorohydrin-ethylene oxide copolymer rubber or epichlorohydrin-ethylene oxide-allyl glycidyl ether copolymer rubber, both of which are ionically conductive, with another rubber such as polyurethane, EPDM, or NBR.

Another option is to impart ionic conductivity to a rubber having low or no conductivity by adding an ionic conductor in an amount of 0.1 to 5.0 parts by mass (preferably 0.5 to 3.0 parts by mass) per 100 parts by mass of the rubber.

The second conductive elastic layer 114 is determined to be ionically conductive, for example, if the difference between the volume resistivity measured at high temperature and humidity and the volume resistivity measured at low temperature and humidity is 0.5 log Ω·cm or more, or if the difference between the volume resistivity measured by applying a voltage of 100 V and the volume resistivity measured by applying a voltage of 1,000 V is 0.5 log Ω·cm or less.

Examples of other additives include materials that are commonly added to elastic layers, such as foaming agents, foaming aids, softeners, plasticizers, curing agents, vulcanizers, vulcanization accelerators, antioxidants, surfactants, coupling agents, and fillers (e.g., silica and calcium carbonate).

A method for manufacturing the transfer roller 111 according to this exemplary embodiment will now be described.

The method begins with providing a roller member including the hollow or solid cylindrical conductive support (shaft) 112 and the first conductive elastic layer 113 disposed on the outer surface of the conductive support 112.

The second conductive elastic layer 114 may be provided on the outer surface of the first conductive elastic layer 113 in any manner. For example, the second conductive elastic layer 114 may be provided on the outer surface of the first conductive elastic layer 113 by providing a tubular elastic member that forms the second conductive elastic layer 114 and inserting the roller member into the elastic member.

The tubular elastic member that forms the second conductive elastic layer 114 may be stretched to an elongation of 50% to 100% or about 50% to about 100% in the radial direction, but not in the longitudinal direction, to come into close contact with the outer surface of the first conductive elastic layer 113.

The tubular elastic member that forms the second conductive elastic layer 114 may be manufactured in any manner. For example, the tubular elastic member may be manufactured by extruding a mixture of a rubber and optionally a conductor and other additives through an extruder into a tubular member and vulcanizing the tubular member with heat.

Image-Forming Apparatus and Process Cartridge

An image-forming apparatus according to this exemplary embodiment includes the transfer roller according to this exemplary embodiment.

Specifically, the image-forming apparatus according to this exemplary embodiment includes, for example, an image carrier, a charging unit that charges a surface of the image carrier, a latent-image forming unit that forms a latent image on the charged surface of the image carrier, a developing unit that develops the latent image formed on the surface of the image carrier with a toner to form a toner image, and a transfer unit that transfers the toner image from the surface of the image carrier to a recording medium. The transfer unit includes the transfer roller according to this exemplary embodiment.

The transfer unit employs, for example, a direct transfer system or an intermediate transfer system. The direct transfer system includes a transfer roller alone. The intermediate transfer system includes an intermediate transfer member having a surface to which a toner image is transferred from the surface of the image carrier, a first transfer roller that transfers the toner image from the surface of the image carrier to the surface of the intermediate transfer member, and a second transfer roller that transfers the toner image from the surface of the intermediate transfer member to the recording medium. The transfer unit includes the transfer roller according to this exemplary embodiment as at least one of the above rollers.

The image-forming apparatus according to this exemplary embodiment may be, for example, a monochrome image-forming apparatus including a developing device containing a monochrome toner, an image-forming apparatus that directly transfers a toner image from an image carrier to a recording medium, a color image-forming apparatus that sequentially transfers toner images from image carriers to an intermediate transfer member, or a tandem color image-forming apparatus in which image carriers provided with developing devices for different colors are arranged in tandem along an intermediate transfer member.

A process cartridge according to this exemplary embodiment is, for example, attachable to and detachable from the above image-forming apparatus. The process cartridge according to this exemplary embodiment includes at least the transfer roller according to this exemplary embodiment. Specifically, the process cartridge according to this exemplary embodiment includes at least one unit selected from the group consisting of an image carrier, a charging unit that charges a surface of the image carrier, a latent-image forming unit that forms a latent image on the charged surface of the image carrier, and a developing unit that develops the latent image formed on the surface of the image carrier with a toner to form a toner image; and a transfer unit that transfers the toner image from the surface of the image carrier to a recording medium. The transfer unit includes the transfer roller according to this exemplary embodiment.

Figure 5:
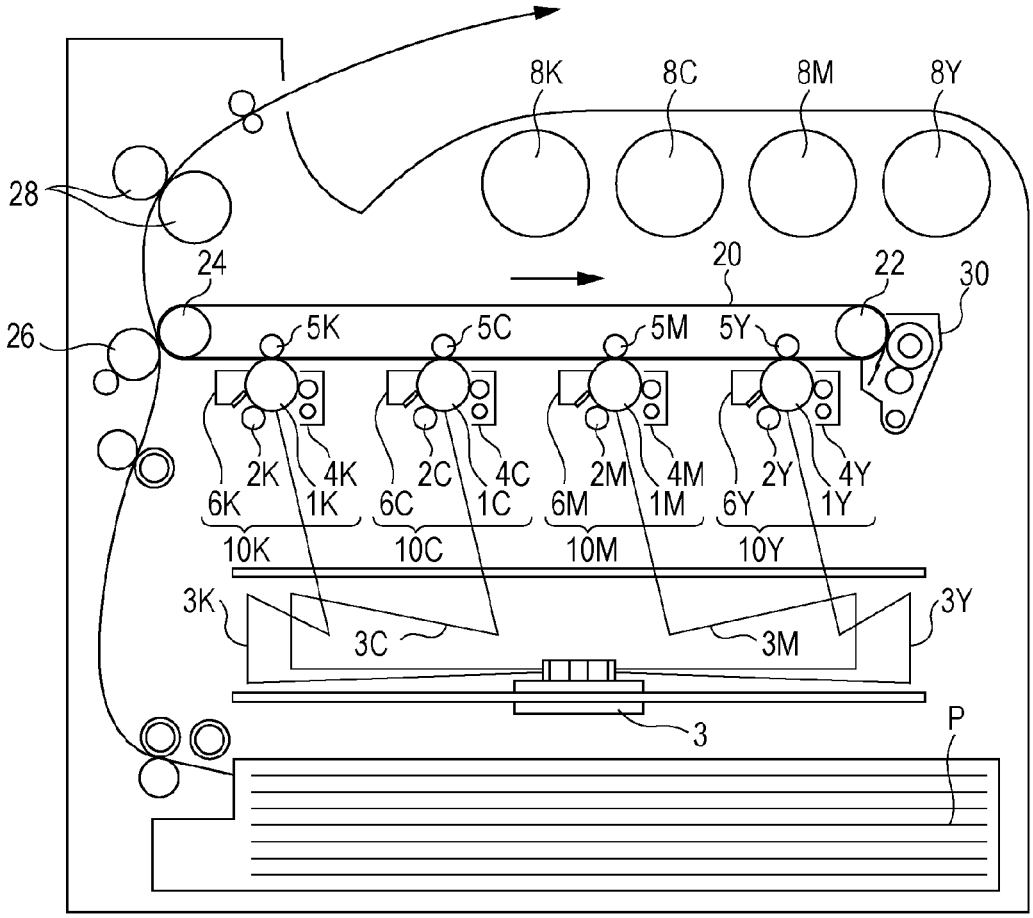
FIG. 5 is a schematic view of an image-forming apparatus according to the exemplary embodiment.

The image-forming apparatus according to this exemplary embodiment will now be described with reference to the drawings. FIG. 5 is a schematic view of the image-forming apparatus according to this exemplary embodiment.

The image-forming apparatus illustrated in FIG. 5 includes first to fourth electrophotographic image-forming units 10Y, 10M, 10C, and 10K that produce yellow (Y), magenta (M), cyan (C), and black (K) images, respectively, based on color separation image data. The image-forming units (hereinafter "units") 10Y, 10M, 10C, and 10K are arranged in parallel at a particular spacing in the horizontal direction. The units 10Y, 10M, 10C, and 10K may also be process cartridges attachable to and detachable from the image-forming apparatus.

An intermediate transfer belt 20, provided as an intermediate transfer member, extends over the units 10Y, 10M, 10C, and 10K in FIG. 5. The intermediate transfer belt 20 is entrained about a drive roller 22 and a support roller 24 spaced apart from each other in the direction from the left to the right in FIG. 5 and disposed in contact with the inner surface of the intermediate transfer belt 20. The transfer unit of the image-forming apparatus is configured such that the intermediate transfer belt 20 travels in the direction from the first unit 10Y toward the fourth unit 10K.

A spring (not shown), for example, biases the support roller 24 in the direction away from the drive roller 22 to apply a particular tension to the intermediate transfer belt 20 entrained about the two rollers 22 and 24. An intermediate-transfer-member cleaning device 30 is disposed opposite the drive roller 22 on the image carrier side of the intermediate transfer belt 20.

The units 10Y, 10M, 10C, and 10K include developing devices (developing units) 4Y, 4M, 4C, and 4K, respectively, to which yellow, magenta, cyan, and black toners can be supplied from toner cartridges 8Y, 8M, 8C, and 8K, respectively.

The first to fourth units 10Y, 10M, 10C, and 10K have the same structure. The description herein will concentrate on the first unit 10Y, which is located upstream in the travel direction of the intermediate transfer belt 20 and which forms a yellow image. The elements of the second to fourth units 4M, 4C, and 4K corresponding to those of the first unit 10Y are designated by like numerals followed by "M" (magenta), "C" (cyan), and "K" (black), respectively, rather than "Y" (yellow), and are not further described herein.

The first unit 10Y includes a photoreceptor 1Y that functions as an image carrier. The photoreceptor 1Y is surrounded by, in sequence, a charging roller 2Y that charges the surface of the photoreceptor 1Y to a particular potential, an exposure device 3 that exposes the charged surface to a laser beam 3Y based on a color separation image signal to form an electrostatic image, a developing device (developing unit) 4Y that supplies a charged toner to the electrostatic image to develop the electrostatic image, a first transfer roller (first transfer unit) 5Y that transfers the developed image to the intermediate transfer belt 20, and a photoreceptor-cleaning device (cleaning unit) 6Y that removes residual toner from the surface of the photoreceptor 1Y with a cleaning blade after the first transfer.

The first transfer roller 5Y is disposed opposite the photoreceptor 1Y inside the intermediate transfer belt 20. The first transfer rollers 5Y, 5M, 5C, and 5K have connected thereto bias power supplies (not shown) that apply a first transfer bias thereto. A controller (not shown) controls the bias power supplies to change the transfer bias applied to the first transfer rollers 5Y, 5M, 5C, and 5K.

The image-forming operation of the first unit 10Y will now be described. Before the operation, the charging roller 2Y charges the surface of the photoreceptor 1Y to a potential of about −600 to about −800 V.

The photoreceptor 1Y includes a conductive substrate (having a volume resistivity at 20° C. of $1\times10^6$ Ω·cm or less) and a photosensitive layer disposed on the substrate. The photosensitive layer, which normally has high resistivity (comparable to the resistivity of common resins), has the property of changing its resistivity in a region irradiated with the laser beam 3Y. The exposure device 3 directs the laser beam 3Y onto the charged surface of the photoreceptor 1Y based on yellow image data received from the controller (not shown). The laser beam 3Y irradiates the photosensitive layer of the photoreceptor 1Y to form an electrostatic image with a yellow print pattern on the surface of the photoreceptor 1Y.

The electrostatic image is an image formed by the charge on the surface of the photoreceptor 1Y. Specifically, the electrostatic image is a negative latent image formed on the surface of the photoreceptor 1Y after the charge dissipates from the region irradiated with the laser beam 3Y, where the resistivity drops, while remaining in the region not irradiated with the laser beam 3Y.

As the photoreceptor 1Y rotates, the electrostatic image formed on the photoreceptor 1Y is brought to a particular development position where the electrostatic image is visualized (developed) by the developing device 4Y.

The developing device 4Y contains, for example, a yellow toner. The yellow toner is charged to the same polarity (negative) as the photoreceptor 1Y by friction as it is stirred inside the developing device 4Y. The charged yellow toner is carried by a developer roller (developer carrier). As the surface of the photoreceptor 1Y passes through the developing device 4Y, the yellow toner is electrostatically attracted to the latent image, which is neutral, on the surface of the photoreceptor 1Y. The yellow toner thus develops the latent image. The photoreceptor 1Y carrying the yellow toner image rotates at a particular speed to transport the toner image developed on the photoreceptor 1Y to a particular first transfer position.

When the yellow toner image on the photoreceptor 1Y is transported to the first transfer position, a particular first transfer bias is applied to the first transfer roller 5Y. The toner image is transferred from the photoreceptor 1Y to the intermediate transfer belt 20 by electrostatic force acting from the photoreceptor 1Y toward the first transfer roller 5Y. The transfer bias applied has the opposite polarity (positive) to the toner (negative). The transfer bias is controlled to, for example, about +10 μA in the first unit 10Y by the controller (not shown).

The cleaning device 6Y removes and collects residual toner from the photoreceptor 1Y.

The controller similarly controls the first transfer biases applied to the first transfer rollers 5M, 5C, and 5K of the second to fourth units 10M, 10C, and 10K.

Thus, the intermediate transfer belt 20 having the yellow toner image transferred thereto by the first unit 10Y is sequentially transported through the second to fourth units 10M, 10C, and 10K, which superimpose toner images of the respective colors on top of each other.

The intermediate transfer belt 20, having the toner images of the four colors superimposed thereon through the first to fourth units 10Y, 10M, 10C, and 10K, reaches a second transfer section. The second transfer section includes the intermediate transfer belt 20, the support roller 24 disposed in contact with the inner surface of the intermediate transfer belt 20, and a second transfer roller (second transfer unit) 26 disposed on the image carrier side of the intermediate transfer belt 20. A recording medium P is fed into a nip between the second transfer roller 26 and the intermediate transfer belt 20 at a particular timing by a feed mechanism. A particular second transfer bias is applied to the support roller 24. The transfer bias applied has the same polarity (negative) as the toner (negative). The toner image is transferred from the intermediate transfer belt 20 to the recording medium P by electrostatic force acting from the intermediate transfer belt 20 toward the recording medium P. The second transfer bias is determined depending on the resistance detected by a resistance detector (not shown) that detects the resistance of the second transfer section, and the voltage is controlled accordingly.

The recording medium P is transported to a fixing device (fixing unit) 28. The fixing device 28 fixes the toner images to the recording medium P by fusing together the superimposed toner images with heat. The recording medium P having the color image fixed thereto is transported to an eject section. Thus, the color-image forming operation is complete.

While the illustrated image-forming apparatus is configured to transfer the toner images via the intermediate transfer belt 20 to the recording medium P, it may be configured in any other manner. For example, the image-forming apparatus may be configured to directly transfer the toner images from the photoreceptors 1Y, 1M, 1C, and 1K to the recording medium P.

EXAMPLES

The present invention is further illustrated by the following non-limiting examples, where parts are by mass unless otherwise indicated.

Fabrication of Coated Roller

Fabrication of Coated Roller 1

A mixture of 60 parts of epichlorohydrin rubber (EPICHLOMER CG-102 from Daiso Co., Ltd.), which has high ionic conductivity with its ethylene oxide group, and 30 parts of acrylonitrile-butadiene rubber (NIPOL DN-219 from Zeon Corporation) is prepared. To the mixture, 1 part of sulfur (from Tsurumi Chemical, Co., Ltd., 200 mesh), 1.5 parts of a vulcanization accelerator (NOCCELER M from Ouchi Shinko Chemical Industrial Co., Ltd.), and 6 parts of benzenesulfonylhydrazide, as a foaming agent, are added, and the mixture is kneaded in an open roll. The mixture is then applied around a stainless steel support roller (conductive support) having a diameter of 12 mm. The stainless steel support roller is heated to 160° C. as a heat source to vulcanize and foam the mixture applied therearound for two hours, thus forming a first conductive elastic layer on the conductive support. The first conductive elastic layer is polished to an outer diameter of 27.0 mm (thickness of first conductive elastic layer: 7.5 mm) to obtain a roller 1 coated with a first conductive elastic layer.

The Asker C hardness of the first conductive elastic layer of the coated roller 1 is measured by placing a measurement needle of an Asker C durometer (from Kobunshi Keiki Co., Ltd.) on the surface of the first conductive elastic layer. The Asker C hardness measured under a load of 1,000 g is 40°.

Fabrication of Elastic Member for Second Conductive Elastic Layer

Fabrication of Elastic Tube 1

A mixture of 60 parts of epichlorohydrin rubber (EPICHLOMER CG-102 from Daiso Co., Ltd.) and 30 parts of acrylonitrile-butadiene rubber (NIPOL DN-219 from Zeon Corporation) is prepared. To the mixture, 1 part of sulfur (from Tsurumi Chemical, Co., Ltd., 200 mesh) and 1.5 parts of a vulcanization accelerator (NOCCELER M from Ouchi Shinko Chemical Industrial Co., Ltd.) are added, and the mixture is kneaded in an open roll. The rubber mixture is extruded through an extruder into a rubber tube having an outer diameter of 15.5 mm and an inner diameter of 13.5 mm (thickness: 1 mm). The rubber tube is vulcanized by heating to 160° C. for one hour. A shaft having a diameter of 13.5 mm is inserted into the vulcanized rubber tube. The rubber tube is polished to a thickness of 0.5 mm and is removed from the shaft. The rubber tube is cut to the width corresponding to the width of the first conductive elastic layer of the coated roller 1.

Thus, a tubular elastic film is fabricated as an elastic tube 1 (inner diameter: 13.5 mm, thickness: 0.5 mm).

Fabrication of Elastic Tube 2

A tubular elastic film is fabricated as in the fabrication of the elastic tube 1 except that the rubber mixture is extruded through an extruder into a rubber tube having an outer diameter of 17.5 mm and an inner diameter of 15.5 mm and that the shaft used for polishing the vulcanized rubber tube is replaced by a shaft having a diameter of 15.5 mm. The elastic film is referred to as an elastic tube 2 (inner diameter: 15.5 mm, thickness: 0.5 mm).

Fabrication of Elastic Tube 3

A tubular elastic film is fabricated as in the fabrication of the elastic tube 1 except that the rubber mixture is extruded through an extruder into a rubber tube having an outer diameter of 19.5 mm and an inner diameter of 17.5 mm and that the shaft used for polishing the vulcanized rubber tube is replaced by a shaft having a diameter of 17.5 mm. The elastic film is referred to as an elastic tube 3 (inner diameter: 17.5 mm, thickness: 0.5 mm).

Fabrication of Elastic Tube 4

A tubular elastic film is fabricated as in the fabrication of the elastic tube 1 except that the rubber mixture is extruded through an extruder into a rubber tube having an outer diameter of 11.0 mm and an inner diameter of 9.0 mm and that the shaft used for polishing the vulcanized rubber tube is replaced by a shaft having a diameter of 9.0 mm. The elastic film is referred to as an elastic tube 4 (inner diameter: 9.0 mm, thickness: 0.5 mm).

Fabrication of Elastic Tube 5

A tubular elastic film is fabricated as in the fabrication of the elastic tube 1 except that the rubber mixture is extruded through an extruder into a rubber tube having an outer diameter of 21.0 mm and an inner diameter of 19.0 mm and that the shaft used for polishing the vulcanized rubber tube is replaced by a shaft having a diameter of 19.0 mm. The elastic film is referred to as an elastic tube 5 (inner diameter: 19.0 mm, thickness: 0.5 mm).

Fabrication of Elastic Tube 6

A tubular elastic film is fabricated as in the fabrication of the elastic tube 1 except that the rubber mixture is extruded through an extruder into a rubber tube having an outer diameter of 24.0 mm and an inner diameter of 22.0 mm and that the shaft used for polishing the vulcanized rubber tube is replaced by a shaft having a diameter of 22.0 mm. The elastic film is referred to as an elastic tube 6 (inner diameter: 22.0 mm, thickness: 0.5 mm).

Example 1

Fabrication of Transfer Roller 1

The coated roller 1 is inserted into the elastic tube 1 while blowing air therein. The elastic tube 1 is stretched to an elongation of 100.0% in the radial direction to come into close contact with the outer surface of the first conductive elastic layer.

Thus, a transfer roller 1 including the first conductive elastic layer and the elastic tube 1 disposed thereon as a second conductive elastic layer is fabricated.

Measurement of Surface Resistivity and Volume Resistivity of Second Conductive Elastic Layer The second conductive elastic layer of the transfer roller 1 is cut open into a sheet. The sheet is cut in the center thereof to form a 4×4 cm measurement sample.

The surface resistivity and volume resistivity of the measurement sample are measured by the procedures for measuring the surface resistivity and volume resistivity of the second conductive elastic layer described above. The common logarithms (log Ω/sq) of the measurements are shown in Table 1 below.

Example 2

Fabrication of Transfer Roller 2

A transfer roller 2 is fabricated as in the fabrication of the transfer roller 1 except that the elastic tube 1 is replaced by the elastic tube 2. The elastic tube 2 is stretched to an elongation of 74.2% in the radial direction to come into close contact with the outer surface of the first conductive elastic layer.

The measurements of the surface resistivity and volume resistivity of the second conductive elastic layer are shown in Table 1 below.

Example 3

Fabrication of Transfer Roller 3

A transfer roller 3 is fabricated as in the fabrication of the transfer roller 1 except that the elastic tube 1 is replaced by the elastic tube 3. The elastic tube 3 is stretched to an elongation of 54.3% in the radial direction to come into close contact with the outer surface of the first conductive elastic layer.

The measurements of the surface resistivity and volume resistivity of the second conductive elastic layer are shown in Table 1 below.

Example 4

Fabrication of Transfer Roller 4

A transfer roller 4 is fabricated as in the fabrication of the transfer roller 1 except that the elastic tube 1 is replaced by the elastic tube 4. The elastic tube 4 is stretched to an elongation of 200.0% in the radial direction to come into close contact with the outer surface of the first conductive elastic layer.

The measurements of the surface resistivity and volume resistivity of the second conductive elastic layer are shown in Table 1 below.

After extended use, the second conductive elastic layer is cracked and degraded much earlier than usual.

Comparative Example 1

Fabrication of Transfer Roller 5

A transfer roller 5 is fabricated as in the fabrication of the transfer roller 1 except that the elastic tube 1 is replaced by the elastic tube 5. The elastic tube 5 is stretched to an elongation of 42.1% in the radial direction to come into close contact with the outer surface of the first conductive elastic layer.

The measurements of the surface resistivity and volume resistivity of the second conductive elastic layer are shown in Table 1 below.

Comparative Example 2

Fabrication of Transfer Roller 6

A transfer roller 6 is fabricated as in the fabrication of the transfer roller 1 except that the elastic tube 1 is replaced by the elastic tube 6. The elastic tube 6 is stretched to an elongation of 22.7% in the radial direction to come into close contact with the outer surface of the first conductive elastic layer.

The measurements of the surface resistivity and volume resistivity of the second conductive elastic layer are shown in Table 1 below.

Measurement of Volume Resistivity of First Conductive Elastic Layer

Measurement rollers are provided by removing the second conductive elastic layers from the transfer rollers of the Examples and the Comparative Examples. The volume resistivity is measured by the procedure for measuring the volume resistivity of the first conductive elastic layer described above. The length of the rollers in the axial direction is 350 mm, and the nip width is 2 mm.

In all the Examples and the Comparative Examples, the common logarithm of the volume resistance of the measurement roller is 5.9 log Ω. In all the Examples and the Comparative Examples, the common logarithm of the volume resistivity of the first conductive elastic layer is 6.9 Ω·cm.

Image Quality Evaluation

The transfer rollers of the Examples and the Comparative Examples are mounted as a first transfer roller on an image-forming apparatus based on DocuCentre-II C6500 from Fuji Xerox Co., Ltd. (modified such that the degree of pressing for forming a nip is adjustable).

The image-forming apparatus is used to form images of characters, lines, and patches (100%, 50% halftone, and 25% halftone) in three different environments (at 22° C. and 55% RH, at 10° C. and 15% RH, and at 28° C. and 85% RH) on $C^2$ A4-size paper from Fuji Xerox Co., Ltd. The test includes LED irradiation after development and before fixing as a stress.

The reproducibility of fine lines and dots is evaluated by observation at 50× magnification according to the following criteria. The results are shown in Table 1 below.

A: The toner is not scattered.

B: The shape is slightly irregular.

C: The outline is blurred with scattered toner.

D: The outline is partially invisible due to scattered toner.

TABLE 1

| | Second conductive elastic layer | | | | |
|---|---|---|---|---|---|
| | Elongation of elastic member in radial direction (%) | Common logarithm of surface resistivity (logΩ/sq) | Common logarithm of volume resistivity (logΩcm) | (Common logarithm of surface resistivity) − (common logarithm of volume resistivity) | Image quality evaluation |
| Ex. 1 | 100.0 | 8.48 | 6.96 | 1.52 | A |
| Ex. 2 | 74.2 | 8.20 | 6.96 | 1.24 | A |
| Ex. 3 | 54.3 | 8.11 | 6.96 | 1.15 | B |

TABLE 1-continued

| | Second conductive elastic layer | | | | |
|---|---|---|---|---|---|
| | Elongation of elastic member in radial direction (%) | Common logarithm of surface resistivity (logΩ/sq) | Common logarithm of volume resistivity (logΩcm) | (Common logarithm of surface resistivity) − (common logarithm of volume resistivity) | Image quality evaluation |
| Ex. 4 | 200.0 | 9.31 | 6.96 | 2.35 | A |
| Com. Ex. 1 | 42.1 | 7.95 | 6.96 | 0.99 | C |
| Com. Ex. 2 | 22.7 | 7.81 | 6.96 | 0.85 | D |

The results shown in Table 1 demonstrate that the transfer rollers of the Examples cause fewer image defects due to scattered toner during transfer than those of the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer roller comprising:

a conductive support;

a first conductive elastic layer disposed on the conductive support; and a second conductive elastic layer disposed on the first conductive elastic layer, wherein a common logarithm of surface resistivity of the second conductive elastic layer is higher than a common logarithm of volume resistivity of the second conductive elastic layer by about 1 or more.

2. The transfer roller according to claim 1, wherein the second conductive elastic layer comprises a tubular elastic member stretched to an elongation of about 50% to about 100% in a radial direction thereof.

3. The transfer roller according to claim 2, wherein the second conductive elastic layer is ionically conductive.

4. The transfer roller according to claim 1, wherein the second conductive elastic layer is ionically conductive.

5. An image-forming apparatus comprising:

an image carrier having a surface;

a charging unit that charges the surface of the image carrier;

a latent-image forming unit that forms a latent image on the charged surface of the image carrier;

a developing unit that develops the latent image formed on the surface of the image carrier with a toner to form a toner image; and a transfer unit that transfers the toner image from the surface of the image carrier to a recording medium, the transfer unit comprising the transfer roller according to claim 1.

6. A process cartridge attachable to and detachable from an image-forming apparatus, the process cartridge comprising:

at least one unit selected from the group consisting of an image carrier having a surface, a charging unit that charges the surface of the image carrier, a latent-image forming unit that forms a latent image on the charged surface of the image carrier, and a developing unit that develops the latent image formed on the surface of the image carrier with a toner to form a toner image; and a transfer unit that transfers the toner image from the surface of the image carrier to a recording medium, the transfer unit comprising the transfer roller according to claim 1.

* * * * *